US012808198B2

(12) United States Patent
Zak et al.

(10) Patent No.: US 12,808,198 B2
(45) Date of Patent: Nov. 24, 2026

(54) FIRE RESISTANT ATTIC STAIRS

(71) Applicant: FAKRO PP Sp. z o. o., Nowy Sacz (PL)

(72) Inventors: Piotr Zak, Chelmiec (PL); Boguslaw Kasinski, Limanowa (PL); Bartlomiej Mos, Nawojowa (PL)

(73) Assignee: FAKRO PP Sp. z o. o., Nowy Sacz (PL)

( * ) Notice: Subject to any disclaimer, the term of this patent is extended or adjusted under 35 U.S.C. 154(b) by 261 days.

(21) Appl. No.: 18/739,402

(22) Filed: Jun. 11, 2024

(65) Prior Publication Data

US 2024/0410179 A1 Dec. 12, 2024

(30) Foreign Application Priority Data

Jun. 12, 2023 (PL) ..... 445187

(51) Int. Cl.
*E04F 11/06* (2006.01)
*E06B 5/06* (2006.01)

(52) U.S. Cl.
CPC ..... *E04F 11/064* (2013.01); *E04F 11/062* (2013.01)

(58) Field of Classification Search
CPC ..... E04F 11/064; E04F 11/062; E04F 11/06; E06C 9/14; E04B 9/003; E06B 5/16; E06B 5/164
USPC ..... 52/784.11
See application file for complete search history.

(56) References Cited

U.S. PATENT DOCUMENTS 2,649,237 A * 8/1953 Bjorklund ..... E04F 11/064 182/98
3,024,863 A * 3/1962 Tapp ..... E04F 11/064 182/78
3,196,494 A * 7/1965 Hartman ..... E06B 5/16 428/920
3,255,063 A * 6/1966 Henneman ..... E06B 5/16 156/87
3,566,541 A * 3/1971 Coulter ..... E04B 1/948 49/467
3,908,062 A * 9/1975 Roberts ..... B32B 11/12 156/39
3,955,330 A * 5/1976 Wendt ..... E06B 5/164 52/211
3,994,110 A * 11/1976 Ropella ..... E06B 5/16 428/920
4,299,059 A * 11/1981 Smith ..... E04B 1/941 182/47
4,541,508 A * 9/1985 Lundh ..... E04F 11/064 182/78

(Continued)

FOREIGN PATENT DOCUMENTS

CH 648630 A * 3/1985
DE 2830317 A1 1/1980

(Continued)

*Primary Examiner* — Robert Canfield
(74) *Attorney, Agent, or Firm* — Bayramoglu Law Offices LLC

(57) ABSTRACT

Attic stairs are constructed out of a box, a ladder, a box closing hatch, so that the ladder is suspended from attic stairs box using hinges and the closing hatch is suspended from the ladder. The closing hatch features a stratified structure, including an inner layer located between two rigid outer strata, where the inner layer is entirely filled with a fire resistant material.

12 Claims, 3 Drawing Sheets

(56) References Cited

U.S. PATENT DOCUMENTS 4,563,845 A * 1/1986 Stipe ..... E06B 5/01 52/202
4,571,915 A * 2/1986 Barman ..... E06B 5/20 52/794.1
4,660,338 A * 4/1987 Wagner ..... E06B 5/164 49/504
5,001,883 A * 3/1991 Landheer ..... E04B 9/0485 52/510
5,239,795 A * 8/1993 Breaux ..... E04F 11/064 52/28
6,271,156 B1 * 8/2001 Gleason ..... E06B 5/16 442/413
7,028,431 B2 * 4/2006 Tlemcani ..... E05F 1/006 52/784.11
8,272,477 B1 * 9/2012 Hudspeth ..... E04B 9/003 182/78
8,579,081 B2 * 11/2013 Richey ..... E06C 1/383 182/77
8,733,025 B2 * 5/2014 Baumert ..... E06B 1/52 49/504
10,273,746 B1 * 4/2019 O'Keeffe ..... E06B 5/162
11,713,572 B2 * 8/2023 Zemler ..... E04B 1/7675 52/396.01
12,503,861 B2 * 12/2025 Kasinski ..... E04F 11/062
2001/0018814 A1 * 9/2001 Degelsegger ..... E06B 3/26 52/205
2002/0124497 A1 * 9/2002 Fortin ..... E06B 5/164 52/784.11
2013/0219804 A1 * 8/2013 Uhl ..... E06B 5/01 52/404.1
2014/0000193 A1 * 1/2014 Daniels ..... E06B 5/161 52/784.11
2014/0196388 A1 * 7/2014 Kasinski ..... E04F 11/062 52/186
2016/0130861 A1 * 5/2016 Daniels ..... E06B 5/161 52/309.4
2023/0304293 A1 * 9/2023 Kasinski ..... E06C 9/085
2023/0323706 A1 * 10/2023 Zak ..... E05B 55/00 70/77
2024/0068295 A1 * 2/2024 Kaczmarski ..... E04F 11/022
2024/0191561 A1 * 6/2024 Noble ..... E06B 5/168
2025/0290325 A1 * 9/2025 Mos ..... E04F 11/066
2025/0354386 A1 * 11/2025 Witowski ..... E04F 11/062

FOREIGN PATENT DOCUMENTS

GB 2087463 A * 5/1982 ..... E06B 5/164
GB 2106972 A * 4/1983 ..... E06B 5/164
GB 2198775 A * 6/1988 ..... E06B 5/164
GB 2241466 A * 9/1991 ..... F16L 59/145
PL 224169 B1 11/2016
WO WO-9721884 A1 * 6/1997 ..... E04B 1/942

* cited by examiner

FIRE RESISTANT ATTIC STAIRS

CROSS REFERENCE TO THE RELATED APPLICATIONS

This application is based upon and claims priority to Polish Patent Application No. P.445187, filed on Jun. 12, 2023, the entire contents of which are incorporated herein by reference.

TECHNICAL FIELD

The subject of the invention is a fire resistant attic stairs with a closing hatch.

BACKGROUND

Attic stairs have been disclosed under application DE2830317A1, constructed out of a box mounted in a ceiling of a room and a box closing hatch, wherein the closing hatch features a stratified structure, so that the hatch inner layer is a thermal insulation layer made out of polyurethane foam for example and the inner layer is shielded on both sides by two outer strata. The external strata are made out of HDF boards. The closing hatch is attached directly to the stair box using a hinge connector. The hinge is constructed out of two arms, one arm of which is attached to the attic stairs box with a bolt and the other arm is attached to the closing hatch with a bolt. The attachment bolts pass through the entire thickness of the closing hatch. A retractable ladder of the attic stairs is attached to the closing hatch. Thus, the closing hatch is a thermal insulation and a load bearing element of the attic stairs.

A fire retardant closer for a building partition opening has been disclosed under patent PL224169B1, and in particular for an opening with retractable stairs, intended for installation in a building partition and in particular one which is fire retardant, which aims to protect against the fire and the associated thermal energy spreading from one room in a building to another room separated by that closer, with the closer featuring a jamb, and in particular at least partially metal, mounted in the building partition, and which features a sash articulated relative to the jamb which closes the opening through the jamb and the sash is filled with fire resistant and thermal insulation materials whereas on the outside it is shielded by form-fitted sheet metal panels. On its surfaces which are perpendicular to the main surface of the sash and which enter the interior of the jamb, the sash is enveloped in a seal which expands when subjected to increased temperatures, whereas the closer is equipped with a bolting mechanism which at least keeps the sash in a closed position during a fire. The jamb comprises a load bearing frame located on one side of a building partition, and an opposite frame, located on the other side of the said partition, separated by insulation inserts made out of a fire resistant material with low heat conductivity.

SUMMARY

The essence of the invention is an attic stairs made out of a box, a ladder and a closing hatch. A ladder is suspended in the box using hinges mounted on the box internal walls, making it possible to lower and raise the ladder when using the attic stairs. The attic stairs ladder is also suspended from a support beam under the ladder, mounted using flat bars to the stairs box. The box together with a retracted ladder is closed from the bottom by the fire resistant closing hatch.

The closing hatch comprising a layered structure, which means it is constructed out of an inner layer and outer layers, wherein the inner layer is completely filled with a fire resistant material, preferably mineral wool, shielded on the outside on both sides by the aforementioned outer, rigid layers, preferably a HDF boards. To strengthen the closing hatch, at least one of the outer layer may be at least doubled. Closing hatch edges are shielded by a protective frame, which is constructed either out of plastic tape, preferably thermoplastic tape, or wooden strips. Closing hatch layers are joined to one another, preferably by gluing. When retracting the attic stairs, the closing hatch is lifted towards the box together with the ladder as the closing hatch is mounted to the ladder using flat bars. The closing hatch outer layer comprising a brackets for the ends of the said flat bars, wherein the brackets are mounted near closing hatch corners. The aforementioned brackets may be mounted to the closing hatch outer layer by screwing, gluing, form-fitting, a rivet-nut and nut connection or other intermediate connectors. The bottom brackets are mounted to the closing hatch further from the attic stairs hinges than the closing hatch top brackets. The flat bars in bottom brackets connect the closing hatch with the ladder, whereas the flat bars in the top brackets connect the closing hatch with attic stairs hinges. Articulated joints between the flat bars with brackets and the ladder as well as the flat bars with hinges comprise articulated joints of a four-bar linkage constructed out of the closing hatch and ladder. There is an expanding seal on the inner circumference of the attic stairs box or on the edges on the closing hatch. When exposed to high temperatures during a fire, the volume of the said seal increases to fill the void between the box and the closing hatch, which prevents fire, hot air and fumes from passing through the fire retardant opening.

Loads which the attic stairs are subjected to during use are transferred directly from the ladder to the attic stairs box and fire resistance is the primary function of the closing hatch. The attic stairs closing hatch is not a load bearing element, its layered structure improves fire resistance properties of the attic stairs and the layers are joined by gluing, which means the closing hatch does not feature strengthening elements in the form of wooden or metal strips. The closing hatch does not need an outer sheet metal shell either as in the disclosed solutions as the rigid outer layer, preferably a double top outer layers, maintains the closing hatch structure rigid. Exposed to high-temperatures, the fire resistant material in the closing hatch inner layer stops the spread of fire and insulates against heat, and the expanding seal along the attic stairs box inner circumference works together with the frame securing the closing hatch edges by establishing a barrier which stops the harmful effects of a fire from reaching adjacent rooms even if standard seals melt or are incinerated.

BRIEF DESCRIPTION OF THE DRAWINGS

The illustration depicts the invention, with given figures depicting the following:

FIG. 4 shows an enlarged view of a closing hatch fragment showing an expansion seal and a double outer layer of the closing hatch.

DETAILED DESCRIPTION OF THE EMBODIMENTS

Figure 1:
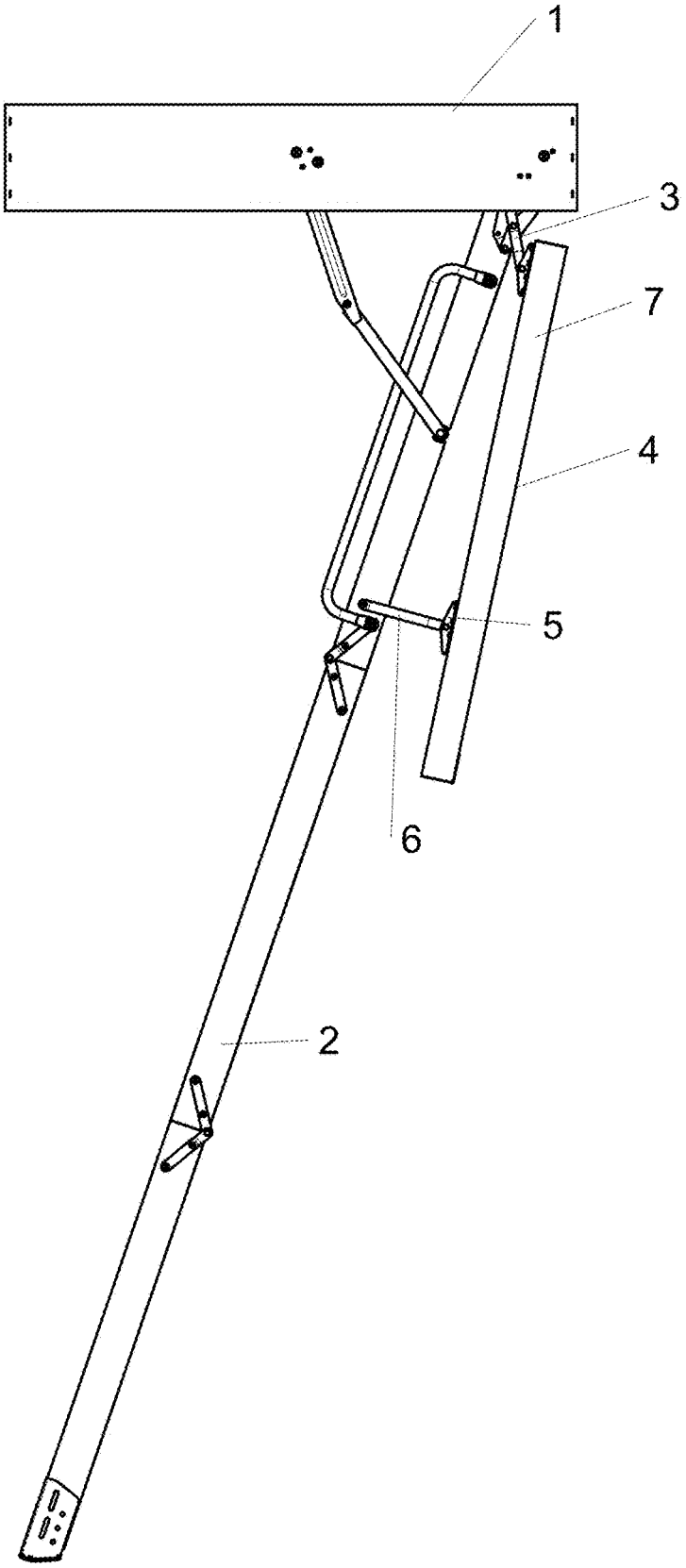
FIG. 1 shows attic stairs.
Figure 2:
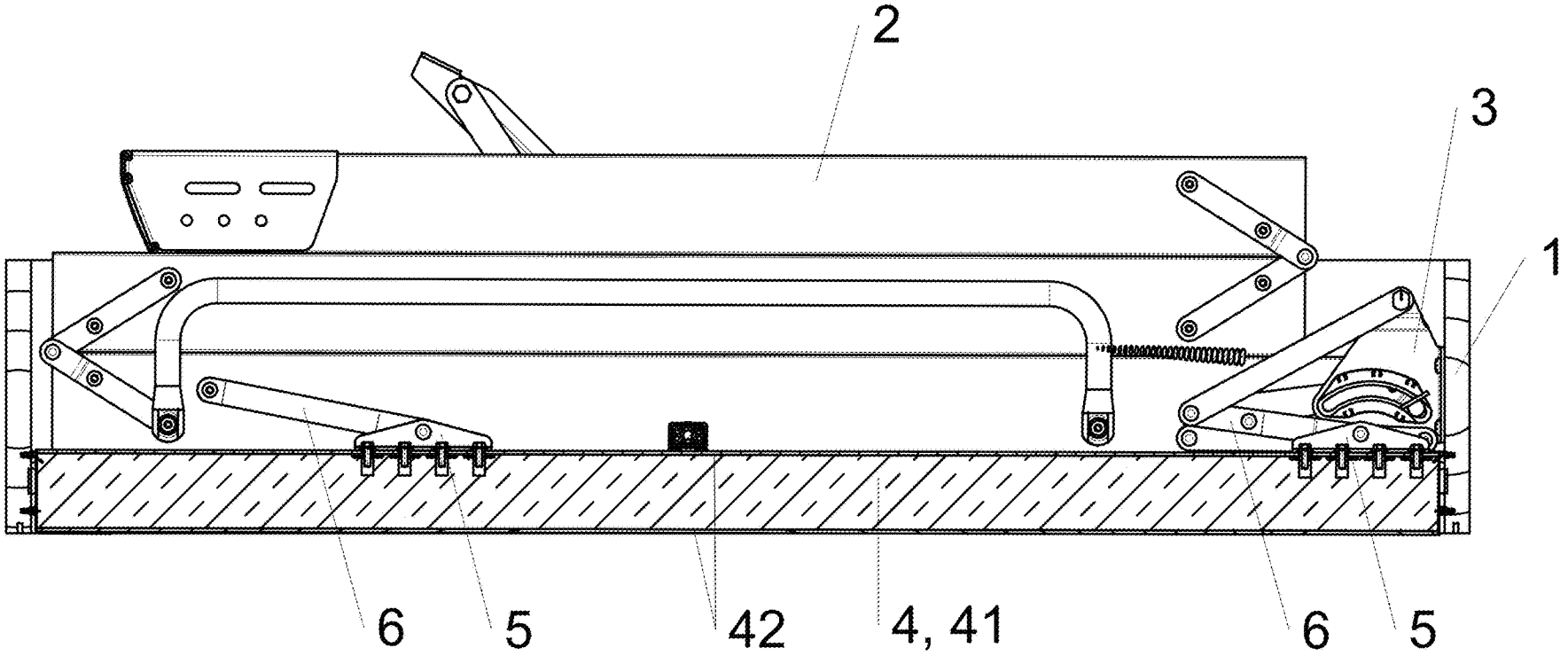
FIG. 2 shows a cross-section view of attic stairs.
Figure 3:
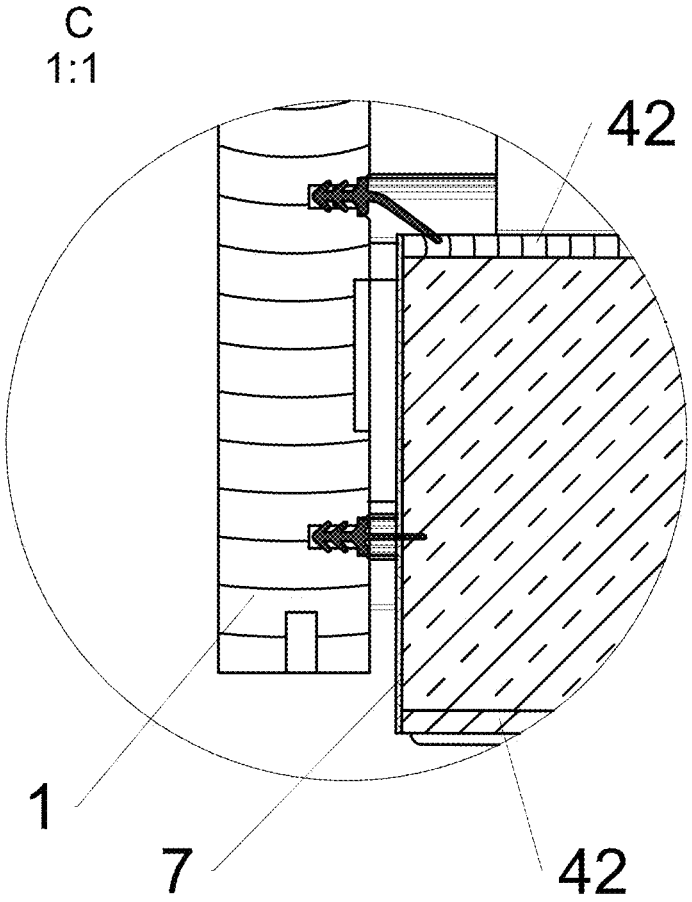
FIG. 3 shows an enlarged view of closing hatch fragment.

The attic stairs are constructed out of box 1 intended for mounting in room ceiling opening. The attic stairs feature multi-segment ladder 2 suspended in box 1 using a pair of hinges 3. Hinges 3 are located at the ends of the first segment of multi-segment ladder 2 stringers and are mounted to the back wall of stairs box 1. Pair of hinges 3 makes it possible to lower and partially retract multi-segment ladder 2 into box 1. Once multi-segment ladder 2 has been folded and partially retracted into box 1 the attic stairs may be closed from the bottom using closing hatch 4. Closing hatch 4 features a layered structure where inner layer 41 is a fire resistant layer shielded on both sides by outer layer 42 in the form of a rigid material. Closing hatch edges are shielded by a protective frame in the form of plastic tape 7. Closing hatch 4 moves relative to box 1 together with multi-segment ladder 2 as brackets 5 are mounted to closing hatch 4 outer layer 42, within which flat bars 6 are mounted using articulated joints which connect closing hatch 4 to multi-segment ladder 2 and hinges 3. Expansion seal 8 mounted to box 1 inner walls is located between box 1 and closing hatch 4. At least one outer layer 42 of closing hatch 4 may comprise a first outer sublayer 42A and a second outer sublayer 42B joined by glue 9.

What is claimed is:

1. Attic stairs, comprising a box, a ladder, and a closing hatch, wherein the ladder is suspended from the box using hinges, and the closing hatch is suspended from the ladder and features a layered structure comprising an inner layer located between two rigid outer layers, wherein the inner layer is entirely filled with a fire resistant material; wherein edges of the closing hatch are shielded by a protective frame; and wherein the protective frame is made out of plastic tape.

2. The attic stairs according to claim 1, wherein the plastic tape is made out of a thermoplastic material.

3. The attic stairs according to claim 2, further comprising an expansion seal mounted to inner walls of the box, wherein the expansion seal is located between the closing hatch and the box.

4. The attic stairs according to claim 2, further comprising an expansion seal mounted to edges of the closing hatch, wherein the expansion seal is located between the closing hatch and the box.

5. The attic stairs according to claim 1, wherein layers of the closing hatch are glued together.

6. The attic stairs according to claim 1, wherein at least one outer layer of the closing hatch is at least a double layer.

7. The attic stairs according to claim 1, wherein one outer layer of the closing hatch comprises brackets in which flat bars of the closing hatch are seated.

8. The attic stairs according to claim 7, wherein the flat bars seated in the brackets of the closing hatch connect the closing hatch with the hinges of the attic stairs and the ladder to establish a four-bar linkage.

9. The attic stairs according to claim 1, wherein the inner layer is a mineral wool layer.

10. The attic stairs according to claim 1, wherein each of the two rigid outer layers is an HDF board.

11. The attic stairs according to claim 1, further comprising an expansion seal mounted to inner walls of the box, wherein the expansion seal is located between the closing hatch and the box.

12. The attic stairs according to claim 1, further comprising an expansion seal mounted to edges of the closing hatch, wherein the expansion seal is located between the closing hatch and the box.

* * * * *